US008366488B2

(12) United States Patent
Akino

(10) Patent No.: US 8,366,488 B2
(45) Date of Patent: Feb. 5, 2013

(54) MICROPHONE CONNECTOR

(75) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 13/217,673

(22) Filed: Aug. 25, 2011

(65) Prior Publication Data

US 2012/0052727 A1 Mar. 1, 2012

(30) Foreign Application Priority Data

Aug. 27, 2010 (JP) ..... 2010-190292

(51) Int. Cl.
*H01R 13/66* (2006.01)

(52) U.S. Cl. ..... 439/620.14; 439/76.1; 439/620.1; 439/607.55; 439/620.24

(58) Field of Classification Search ..... 439/76.1, 439/607.55, 620.09, 620.1, 620.14, 620.24, 439/620.25
See application file for complete search history.

(56) References Cited

U.S. PATENT DOCUMENTS

| | | | | |
|---|---|---|---|---|
| 6,837,747 | B1 * | 1/2005 | Kosmala | 439/620.09 |
| 7,063,546 | B2 * | 6/2006 | Akino | 439/620.21 |
| 7,104,844 | B2 * | 9/2006 | Akino | 439/620.21 |
| 7,168,965 | B2 * | 1/2007 | Akino | 439/95 |
| 7,267,560 | B2 * | 9/2007 | Akino | 439/101 |
| 7,390,221 | B2 * | 6/2008 | Akino | 439/607.17 |
| 7,500,878 | B2 * | 3/2009 | Akino | 439/607.41 |
| 7,517,234 | B2 * | 4/2009 | Akino | 439/106 |
| 7,540,780 | B2 * | 6/2009 | Akino | 439/620.14 |
| 7,630,506 | B2 * | 12/2009 | Akino | 381/174 |
| 7,664,286 | B2 * | 2/2010 | Akino | 381/361 |
| 7,801,316 | B2 * | 9/2010 | Akino | 381/174 |
| 8,066,531 | B2 * | 11/2011 | Kanatsu | 439/620.22 |
| 8,070,518 | B2 * | 12/2011 | Akino | 439/607.41 |
| 8,077,887 | B2 * | 12/2011 | Akino | 381/189 |
| 8,194,895 | B2 * | 6/2012 | Akino | 381/174 |
| 2003/0171034 | A1 * | 9/2003 | Edwards et al. | 439/620 |
| 2004/0198087 | A1 * | 10/2004 | Lin | 439/321 |
| 2005/0148227 | A1 * | 7/2005 | Akino | 439/218 |
| 2005/0239305 | A1 * | 10/2005 | Akino | 439/106 |
| 2005/0254670 | A1 * | 11/2005 | Akino | 381/113 |
| 2006/0040543 | A1 * | 2/2006 | Akino | 439/445 |
| 2006/0046538 | A1 * | 3/2006 | Akino | 439/101 |
| 2006/0046570 | A1 * | 3/2006 | Akino | 439/610 |
| 2006/0084298 | A1 * | 4/2006 | Akino | 439/95 |
| 2006/0098835 | A1 * | 5/2006 | Akino | 381/369 |

(Continued)

FOREIGN PATENT DOCUMENTS

| | | |
|---|---|---|
| JP | 2005-094575 | 4/2005 |
| JP | 2005-311752 | 11/2005 |

*Primary Examiner* — Ross Gushi
(74) *Attorney, Agent, or Firm* — Whitham Curtis Christofferson & Cook, PC

(57) ABSTRACT

A three-pin microphone connector includes a connector base composed of an electrical insulator; a printed circuit board; a first pin for grounding and second and third pins for signals which penetrate through the connector base and the printed circuit board, a shield layer electrically connected to the first pin but not to the second and third pins, overlying almost the entire surface of the printed circuit board which faces the connector base; a first shield cover through which the three pins penetrate, covering the printed circuit board and the connector base from one surface, and a second shield cover through which the three pins penetrate, covering the connector base from the other surface. The first and second shield covers squeeze together at both ends to enwrap the connector base.

6 Claims, 4 Drawing Sheets

U.S. PATENT DOCUMENTS

2006/0105602 A1* 5/2006 Akino ..... 439/218
2006/0133626 A1* 6/2006 Akino ..... 381/174
2006/0159294 A1* 7/2006 Akino ..... 381/174
2007/0238358 A1* 10/2007 Akino ..... 439/610
2008/0038946 A1* 2/2008 Akino ..... 439/95
2008/0175412 A1* 7/2008 Akino et al. ..... 381/111
2008/0200056 A1* 8/2008 Huang ..... 439/310
2008/0207057 A1* 8/2008 Akino ..... 439/610
2009/0262968 A1* 10/2009 Akino ..... 381/369
2010/0184328 A1* 7/2010 Kanatsu ..... 439/607.01
2011/0007925 A1* 1/2011 Akino ..... 381/369
2011/0013800 A1* 1/2011 Akino ..... 381/361
2011/0086547 A1* 4/2011 Akino ..... 439/607.41
2011/0235830 A1* 9/2011 Akino ..... 381/174
2012/0009819 A1* 1/2012 Akino ..... 439/607.28
2012/0052727 A1* 3/2012 Akino ..... 439/607.27

* cited by examiner

MICROPHONE CONNECTOR

BACKGROUND OF THE INVENTION

1. Field of the Invention

The present invention relates to a microphone connector, and specifically, a microphone connector having a structure that effectively prevents a high-frequency current from entering the microphone through a cable.

2. Related Background Art

A capacitor microphone includes a microphone unit having extremely-high output impedance and, thus, accommodates an impedance converter including a FET (Field-Effect Transistor) that reduces impedance to output audio signals. The audio signals are output through a connector and a cable to the exterior. Normally the capacitor microphone includes a phantom power supply to output the audio signals electro-acoustically converted by a microphone through a balanced-shielded cable for the phantom power supply. That is, a microphone cable is composed of the balanced-shielded cable. A microphone casing or a handheld microphone has a three-pin microphone connector in a grip to be connected to the balanced-shielded cable. The connector, generally specified in ETAT RC-5236 "Latch Lock Type Round Connector for Audio Equipment", is widely known.

The connector provides a connector base composed of an electrical insulator such as PBT (polybutylene terephthalate). A first pin for grounding, a second pin for the hot side of signals, and a third pin for the cold side of the signals penetrate through the connector base. A connector of a handheld microphone, for example, is mounted in a cylindrical connector casing threadably fixed to the end of a microphone grip. Commonly used microphone grips and cylindrical connector casings are composed of a metallic material such as brass. The microphone grip also functions as a shield cover for inner electrical components. The connector base has a female thread into which a male thread is screwed. The male thread electrically connects the first pin for grounding to the cylindrical connector casing.

If such a connector is connected to the balanced-shielded cable drawn from the phantom power supply and the microphone and the microphone cable are subjected to strong electromagnetic waves, the electromagnetic waves may enter the microphone through the connector to be demodulated and output from the microphone as noise having an audible frequency.

To address this circumstance, a microphone connector is proposed which includes a connecter base covered with a shield cover on at least one surface, as is disclosed in, for example, Japanese Unexamined Patent Application Publication No. 2005-094575. The shield cover is electrically connected to the first pin for grounding, not to the second and third pins for signals.

Japanese Unexamined Patent Application Publication No. 2005-311752 discloses a microphone connector including a printed circuit board disposed on one surface of a connector base through which three pins penetrate and a shield cover through which these three pins penetrate and is disposed to cover the printed circuit board and the connector base. In the invention disclosed in Japanese Unexamined Patent Application Publication No. 2005-311752, the printed circuit board mounts a capacitor element for preventing entrance of high-frequency electromagnetic waves and a zener-diode element for preventing destruction of circuits due to static electricity, and the surface of the printed circuit board on which the capacitor element and the zener-diode element are disposed is covered with the shield cover.

These patent documents describe that high-frequency electrical currents can be prevented from entering the microphone through a connector.

Recent achievement of widespread use of, for example, cellular phones increases radiation of electromagnetic waves having higher frequencies in close proximity to microphones. Disadvantageously, this generates noises caused by the electromagnetic waves. In the inventions disclosed in the patent documents, however, noises caused by electromagnetic waves having extremely high frequencies and emitted in close proximity to microphones cannot be sufficiently shielded. It is needed to still further increase a shielding effect of the shield cover. Furthermore, in the invention disclosed in Japanese Unexamined Patent Application Publication No. 2005-311752, a ground pattern of the printed circuit board and a shield cover are electrically connected only by mechanically connecting the shield cover to the pin for grounding. Accordingly the shielding effect against the electromagnetic waves having high frequency cannot be achieved.

SUMMARY OF THE INVENTION

An object of the prevent invention is to provide a microphone connector that ensures an electrical connection between a shield cover and a ground pattern of a printed circuit board, increases a shielding effect against electromagnetic waves having high frequency and generated by using, for example, cellular phones, and prevents radiation of high-frequency signals into the microphone.

A main feature of the present invention provides a three-pin microphone connector including: a connector base composed of an electrical insulator; a printed circuit board; a first pin for grounding and second and third pins for signals which penetrate through the connector base and the printed circuit board; a shield layer electrically connected to the first pin but not to the second pin and the third pin, overlying almost an entire surface of the printed circuit board facing the connector base; a first shield cover through which the three pins penetrate, covering the printed circuit board and the connector base from one surface; and a second shield cover through which the three pins penetrate, covering the connector base from the other surface. The first and second shield covers enwrap the connector base by squeezing together at both ends.

According to the present invention, first and second shield covers enwrap a connector base by squeezing together at both ends, thereby adding sufficient suppress strength to the shield covers and a ground pattern of a printed circuit board to ensure electrical connection at this area. An electrostatic shield is configured to entirely surround components of the connector, thereby preventing radiation of high-frequency signals into the microphone.

DESCRIPTION OF THE PREFERRED EMBODIMENTS

An embodiment of a microphone connector according to the present invention is explained below with reference to FIGS. 1 to 4.

Figure 1:
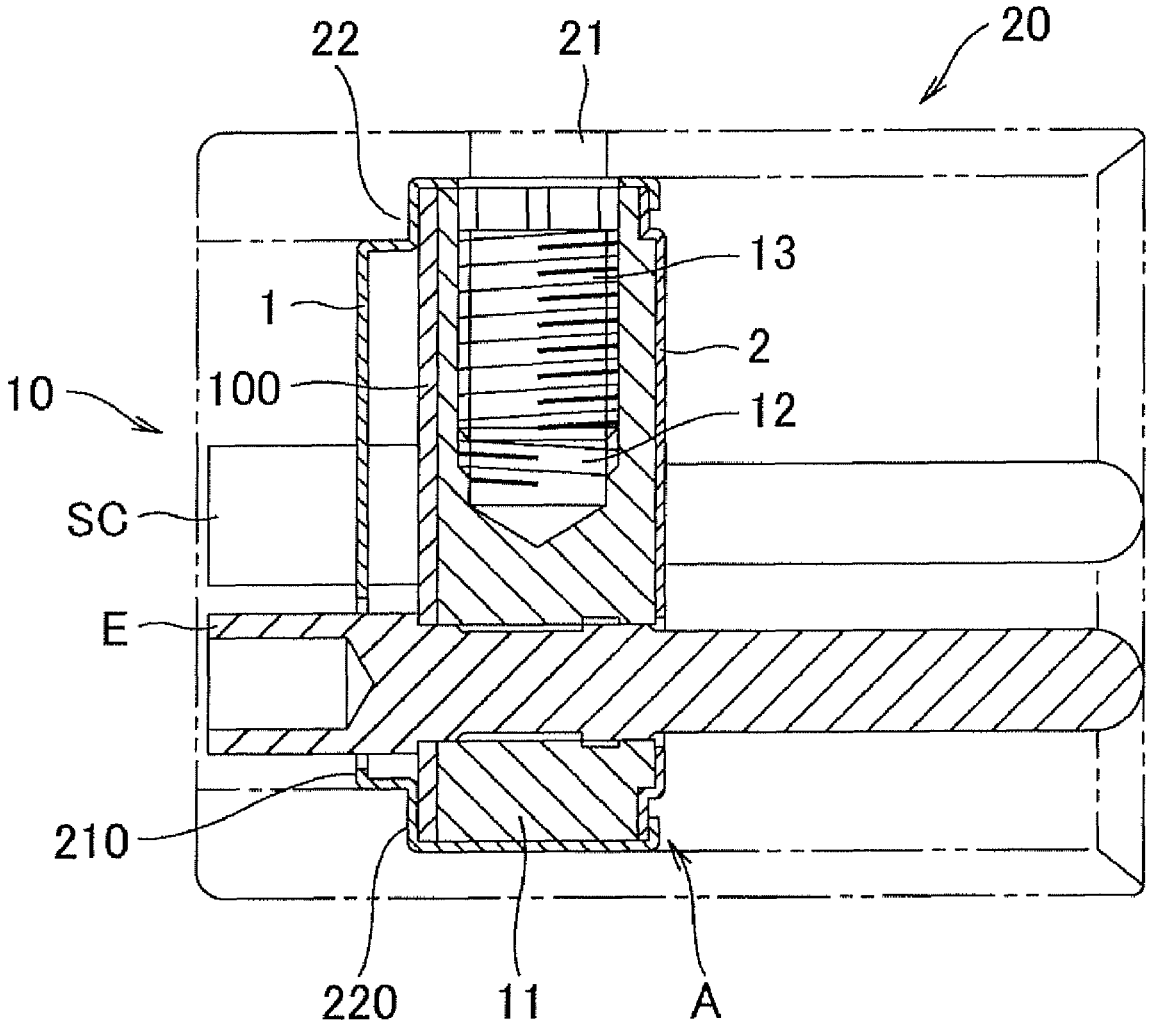
FIG. 1 is a vertical cross-sectional view of a microphone connector according to an embodiment of the present invention.

In FIG. 1, a connector 10 has a connector base 11 mainly composed of a cylindrical electrical insulator, a printed circuit board 100 overlies one surface of the connector base 11, a first bottomed-cylindrical shield cover 1 covering the printed circuit board 100, a second discal shield cover 2, and three pins including a first pin E for grounding, a second pin (not shown) for transmitting signals of the hot side, and a third pin SC for transmitting signals of the cold side. These three pins penetrate through the first shield cover 1, the printed circuit board 100, the connector base 11 and the second shield cover 2 in this order.

The first cylindrical shield cover 1 through which the three pins penetrate covers the peripheral surfaces of the printed circuit board 100 and the connector base 11 from the surface of the printed circuit board 100. The second discal shield cover 2 through which the three pins penetrate covers the connector base 11 from the surface opposite to the surface on which the printed circuit board 100 is disposed. In a state where these members are disposed as described above, the open edge of the shield cover 1 exists outward of the shield cover 2 and is inwardly bended in a radial direction so as to enfold the outer peripheral edge of the connector base 11. Reference symbol A in FIG. 1 represents this bended portion. Thus, the shield covers 1 and 2 squeeze together at both ends to enwrap the connector base 11.

Accordingly, the connector base 11, three pins, printed circuit board 100, and the shield covers 1 and 2 are integrally assembled into one unit.

The outer peripheral edge of the shield cover 2 may be bended toward the outer peripheral edge of the shield cover 1, these shield covers 1 and 2, then, squeeze together at both ends thereof to be unified, and enwrap the connector base 11.

As illustrated in FIG. 1, the connector 10 is mounted in a cylindrical connector housing 20. The cylindrical connector housing 20 is threadably fixed to the end of a microphone grip or a microphone casing. The cylindrical connector housing 20 and the microphone grip or the microphone casing are composed of a metallic material such as brass and also function as a shield cover for inner electrical components. A thread hole 12 is formed on the connector base 11 from the outer peripheral surface in a radial direction. A locking thread 13 is screwed into the thread hole 12. A hole 21 through which the locking thread 13 is drawn is provided in the cylindrical connector housing 20 with an appropriate driver. The locking thread 13 has a small-diameter head and a step shoulder. The small-diameter head of the locking thread 13 is approximately equal in diameter to the hole 21 to be fitted into the hole 21. The shoulder of the locking thread 13 abuts on the peripheral edge of the hole 21.

Accordingly, if the locking thread 13 is drawn from the thread hole 12, the shoulder of the locking thread 13 abuts on the peripheral edge of the hole 21 and the connector base 11 covered with the shield covers 1 and 2 is suppressed in an opposite direction to the hole 21. The suppress strength enforces the mutual contacts between the cylindrical connector housing 20, the shield covers 1 and 2, and the connector base 11.

In the embodiment illustrated in FIG. 1, a step 22 is formed on the longitudinal back of the inner periphery of the cylindrical connector housing 20 by decreasing the diameter of the longitudinal back of the cylindrical connector housing 20. Meanwhile, a shoulder 220 is formed on the first shield cover 1 by decreasing the diameter adjacent to the bottom of the first shield cover 1. The shoulder 220 comes into contact with the step 22 of the cylindrical connector housing 20 and the first shield cover 1 is brought into intimate contact with the interior of the cylindrical connector housing 20. This structure can bring the first shield cover 1 into more solid contact with an after-mentioned shielding electrode 121 provided on the printed circuit board 100, thereby resulting in improvement of a shielding effect.

The connector 11 is composed of a synthetic resin such as PBT (polybutylene terephthalate) and has a cylindrical shape. The connector base 11 provides, by press-fitting, three pins including a first pin E for grounding, a second pin (not shown) for the hot side, and a third pin SC for the cold side. Since the second pin for the hot side is disposed at the front of the first pin E for grounding in FIG. 1, it is not shown in FIG. 1.

Figure 3:
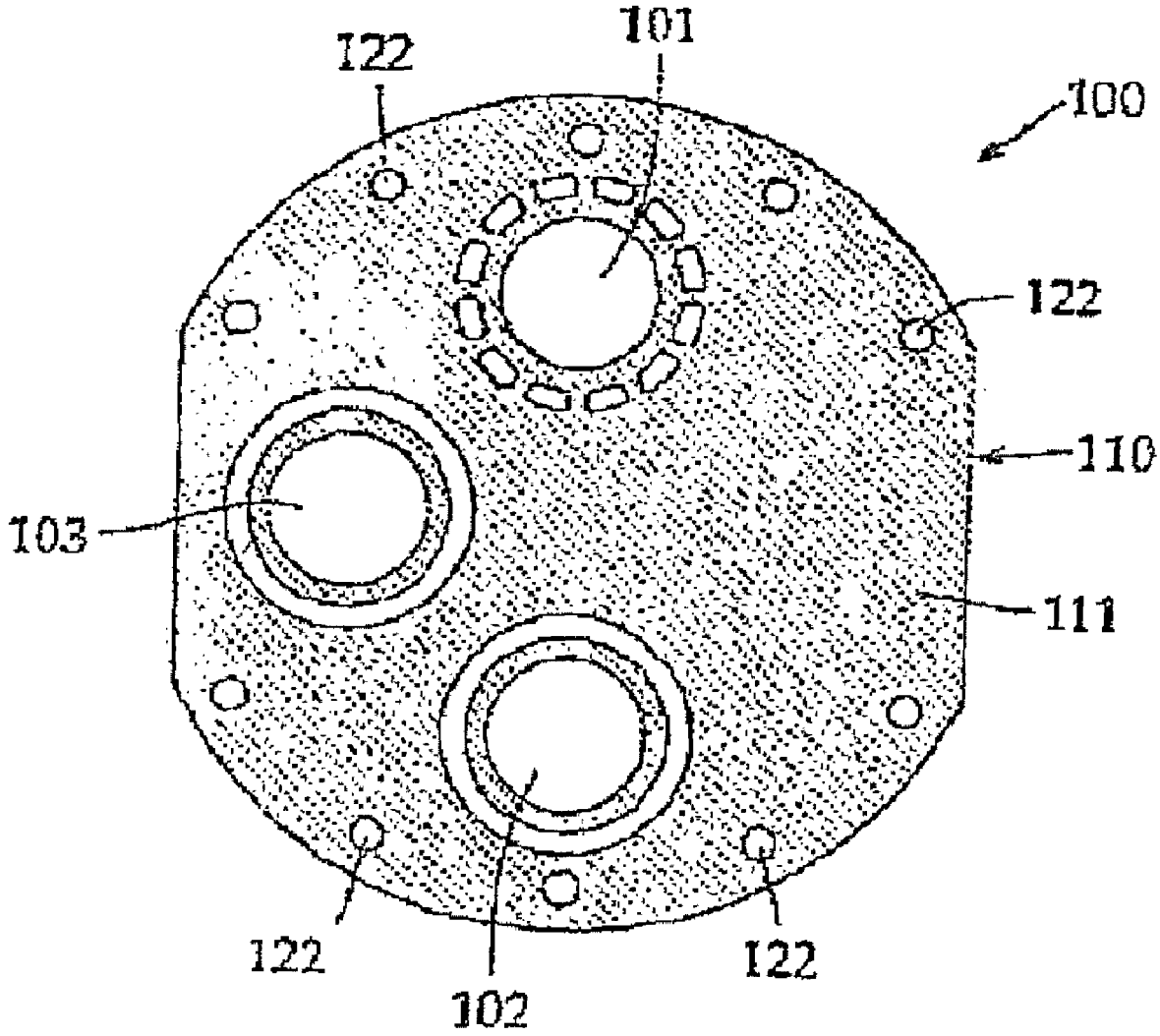
FIG. 3 is a front view of a surface of a printed circuit board, which faces a connector base in the embodiment.

The printed circuit board 100 overlies the surface of the connector base 11 at the side of the first shield cover 1. The three pins penetrate through the printed circuit board 100. As illustrated in FIG. 3, a shield layer 111 overlies the entire surface 110 of the printed circuit board 100. The shield layer 111 is electrically connected to the first pin but not to the second and third pins.

Figure 4:
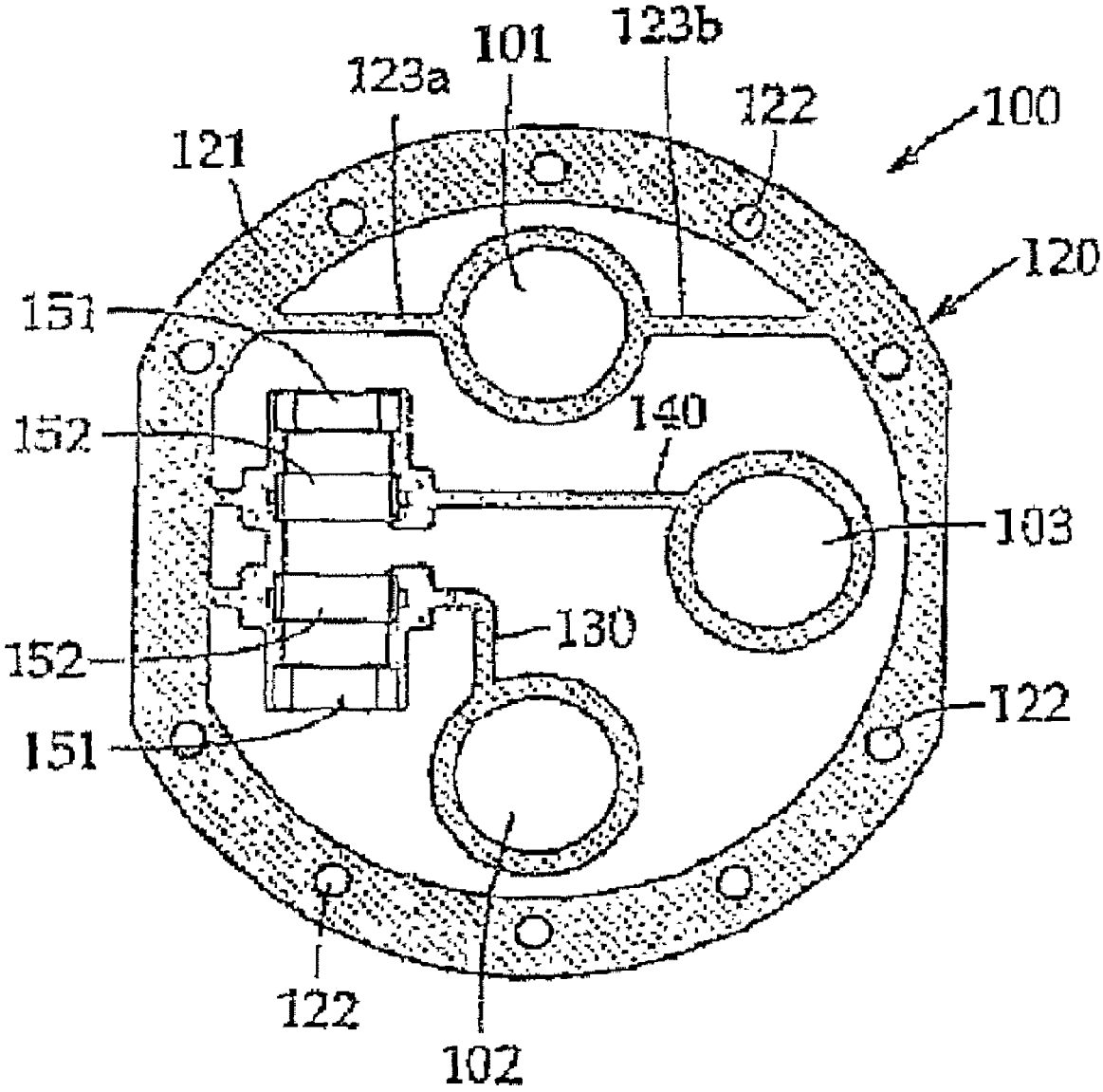
FIG. 4 is a rear view illustrating a surface the printed circuit board, on which a capacitor element and a zener-diode element are mounted.

The printed circuit board 100 is a dual-sided printed circuit board. FIG. 3 illustrates a pattern on the surface 110 facing the connector base 11 and FIG. 4 illustrates a pattern on a surface 120 mounting components. As shown in FIGS. 3 and 4, the printed circuit board 100 has three through holes for pins, namely, a first through hole 101 through which the first pin E for grounding penetrates, a second through hole 102 through which the second pin for the hot side penetrates, and a third through hole 103 through which the third pin SC for the cold side penetrates. In FIG. 3, the shield layer 111 composed, for example, of a beaten-copper conductive pattern overlies approximately the entire surface 110 facing the connector base 11, except the circumference of the second and third through holes 102, 103 through which the second and third pins respectively penetrate. Accordingly, the shield layer 111 is electrically connected to the first pin but not to the second and third pins.

The shield layer 111 interrupts electromagnetic waves entering the microphone through between those pins in the connector base 11 via, for example, the microphone cable (not shown).

As illustrated in FIG. 4, a shield electrode 121 is formed around the entire peripheral edge of the printed circuit board 100 on the side of the surface 120 mounting the components. As shown in FIGS. 3 and 4, a plurality of through holes 122 are provided on the peripheral edge of the printed circuit board 100 with equal intervals in a circumferential direction. A peripheral wall of each of the through holes 122 is coated with a conductive material. Printed patterns on both sides of the printed circuit board 100 are electrically connected with each other via this coating on the through holes 122. These printed patterns electrically connected with each other via the coating on the through holes 122 are referred to as the shield layer 111 and the shield electrode 121 in the illustrated embodiment.

The shield layer 111 is electrically connected to the first pin E for grounding via the through hole coating on the inner peripheral surface of the first through hole 101 but not to the second pin and the third pin SC, for signals. The through hole coating is also applied to the inner peripheral surfaces of the second and third through holes 102, 103 to ensure electrical conduction between the second and third pins for signals.

The first through hole 101 is connected to the shield electrode 121 in two different spots, through lead wires 123*a*, 123*b* that respectively extend from the fringe of the first through hole 101 to the opposite directions of one another.

The second and third through holes 102, 103 are connected to lead wires 130, 140 respectively. Two pairs of capacitor elements 151 and zener-diode elements 152 are mounted, in parallel, between the lead wire 130 and the shield electrode 121 and between the lead wire 140 and the shield electrode 121, respectively.

The capacitor elements 151 prevent entrance of the high-frequency electromagnetic waves, while the zener-diode elements 152 prevent destruction of circuits. Both of the capacitor elements 151 and the zener-diode elements 152 are preferably composed of automatically surface-mountable chip parts. The lead wires 130, 140 have guiding branches for capacitor and diode respectively so that the capacitor element 151 and the zener-diode element 152 are mounted in parallel.

If strong electromagnetic waves invade the microphone cable (not shown) connected to the connector 10 and inrush current flows from the second pin and third pin SC to the shield electrode 121, the capacitor elements 151 may be destroyed. In order to prevent this, it is preferable to design the pattern and adjust each length of the branches so that the inrush current flows through the zener-diode elements 152 before the capacitor elements 151. The branches for the capacitor elements 151, thus, have wire-lengths longer than the branches for the zener-diode elements 152, thereby wiring the branches for the capacitor elements 151 around the branches for the zener-diode elements 152. Otherwise, it is possible for the branches for zener-diode elements to have thick wires, while the branches for the capacitor elements have thin and long wires.

Figure 2:
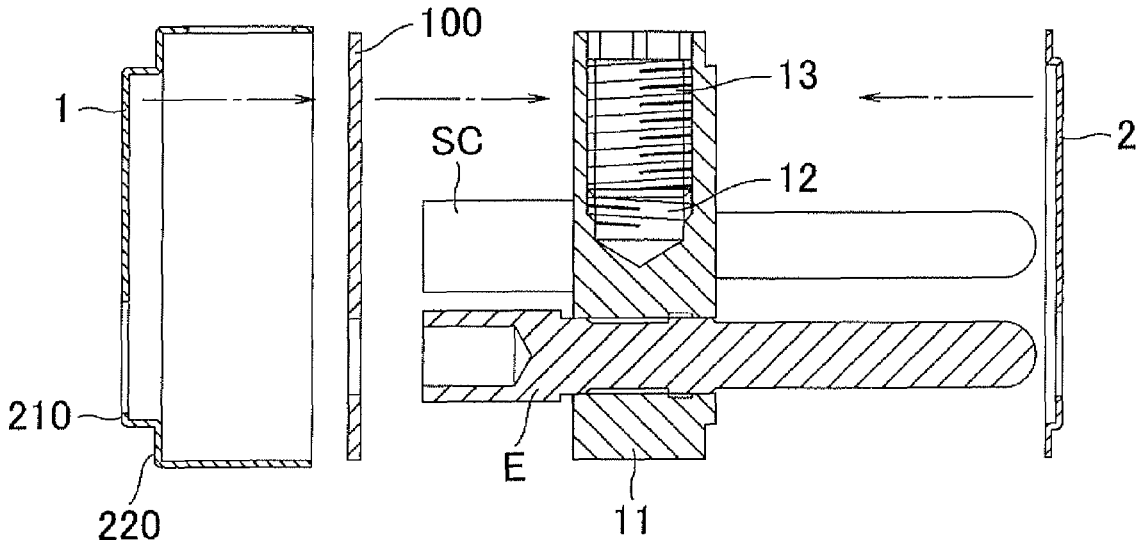
FIG. 2 is an exploded vertical cross-sectional view of the embodiment.

In FIGS. 1 and 2, the diameter adjacent to the bottom of the first shield cover 1 decreases to provide the shoulder 220 as explained above. When the first shield cover 1 covers the printed circuit board 100, the shoulder 220 comes into surface-contact with the shield electrode 121 formed on the printed circuit board 100. The first and second shield covers 1 and 2 are not limited to the configurations of the illustrated-embodiment but may be optionally modified. The configurations of the first and second shield covers 1, 2 in the above-described embodiment, however, allow them to easily fit each other after mounting the printed circuit board 100 and achieve an intensive contact between the printed circuit board 100 and the first shield cover 1.

The first and second shield covers 1 and 2 squeeze together at both ends to wrap the connector base 11, thereby applying great pressure to ground patterns of the first shield cover 1 and the printed circuit board 100. Accordingly, electrical connection at the connection part between the first and second shield covers 1 and 2 are ensured and an electrostatic shield surrounds the entire part of the connector 10, thereby preventing radiation of high frequency signals from entering the microphone including the connector 10. Furthermore, as illustrated in FIG. 1, the area of contact between the first and second shield covers 1, 2 and the cylindrical connector housing 20 can be widened to improve a shielding effect against high-frequency electromagnetic waves.

The capacitor elements 151 and the zener-diode elements 152 mounted on the printed circuit board 100 are disposed in a space defined by the printed circuit board 100 and the first shield cover 1. The first shield cover 1, therefore, prevents high-frequency signals from entering the microphone through the wires of the capacitor elements 151. Furthermore, by wrapping the connector 11 with the first and second shield covers 1, 2, radiation of high-frequency signals can be more surely prevented. The diameters of the through holes for pins formed on the first and second shield covers 1 and 2 preferably keep to the minimum in size necessary to draw each pin therethough.

What is claimed is:

1. A microphone connector, comprising:

a connector base composed of an electrical insulator;

a printed circuit board;

a first pin for grounding and second and third pins for signals, penetrating through the connector base and the printed circuit board;

a shield layer electrically connected to the first pin but not to the second pin and the third pin, overlying almost an entire surface of the printed circuit board facing the connector base;

a first shield cover through which the three pins penetrate, covering the printed circuit board and the connector base from one surface; and a second shield cover through which the three pins penetrate, covering the connector base from the other surface, wherein the first shield cover and the second shield cover squeeze together at both ends to enwrap the connector base.

2. The microphone connector according to claim 1, further comprising:

capacitor elements for preventing entrance of high-frequency electromagnetic waves and zener-diode elements for preventing destruction of circuits by static electricity.

3. The microphone connector according to claim 2, wherein, the capacitor elements and the zener-diode elements are disposed in a space defined by the printed circuit board and the first shield cover.

4. The microphone connector according to claim 1, wherein through holes are formed at a peripheral edge of the printed circuit board to electrically connect a shield layer formed on one surface of the printed circuit board and a shield electrode formed on the other surface of the printed circuit board therethough.

5. The microphone connector according to claim 4, wherein the first shield cover and the second shield cover are electrically connected to the shield electrode.

6. The microphone connector according to claim 1, wherein each of one side of the first shield cover and the second shield cover has a bottomed-cylindrical shape, while each of the other side of the first shield cover and second shield cover has discal shape that covers open ends of the shield covers having the bottomed-cylindrical shape.

* * * * *